United States Patent [19]

Reu Boiu

[11] 4,185,715

[45] Jan. 29, 1980

[54] SOUND-ATTENUATING MUFFLER FOR EXHAUST GASES

[76] Inventor: Rudolph Reu Boiu, 200 N. Minnesota, #23, Glendora, Calif. 91740

[21] Appl. No.: 910,219

[22] Filed: May 30, 1978

[51] Int. Cl.[2] ..... F01N 1/08

[52] U.S. Cl. ..... 181/266; 181/227; 181/240; 181/268; 181/272; 181/273; 181/275; 181/276

[58] Field of Search ..... 181/212, 227, 228, 231, 181/232, 240, 243, 264, 265, 266, 268–276, 279–282; 138/37, 40, 42, DIG. 11

[56] References Cited

U.S. PATENT DOCUMENTS

| | | | |
|---|---|---|---|
| 2,445,045 | 7/1948 | Strachan | 181/280 |
| 2,468,454 | 4/1949 | Mason | 181/248 |
| 3,086,611 | 4/1963 | Nelson | 181/265 |
| 3,259,206 | 6/1966 | Straw | 181/227 |
| 3,263,772 | 8/1966 | Irwin et al. | 181/227 |
| 3,353,628 | 11/1967 | Gilbert | 181/265 |

*Primary Examiner*—L. T. Hix
*Assistant Examiner*—Benjamin R. Fuller
*Attorney, Agent, or Firm*—Boniard I. Brown

[57] ABSTRACT

A sound-attenuating muffler for reducing the acoustic energy in an exhaust gas stream has an elongated cylindrical housing with a small ratio of diameter to length. Axially extending vanes are radially disposed to define an added number of flow passages. Exhaust gas enters an entry passage defined between two vanes, travels past a side-branch resonator and terminates in the entry nozzle of a Helmholtz chamber. The flow turns through a port in one of the vanes and enters a reverse-flow passage, also defined between two vanes, flows past a side-branch resonator and is reversed again through a port through another vane. A third side-branch resonator is provided in the exit region. The muffler may comprise two or more separate similar muffler sections defining such serpentine gas flow paths, and the exit region of an upstream section may then be continuous with the entry region of a downstream section.

10 Claims, 13 Drawing Figures

BOTTOM CHANNEL
TOP LEFT CHANNEL
TOP RIGHT CHANNEL
DOWNSTREAM SECTION
UPSTREAM SECTION

SOUND-ATTENUATING MUFFLER FOR EXHAUST GASES

BACKGROUND OF THE INVENTION

The invention relates to exhaust mufflers, and more particularly to sound-attenuating mufflers for internal combustion engines and other sources of pulsating gas flow with substantial acoustic energy transport.

The use of mufflers to reduce the exhaust noise emanating from internal combustion engines, air compressors, and the like has been a feature demanded by the need to ensure a bearable acoustic environment for persons in their vicinity. As a consequence of such need, reinforced by legal restrictions as to the amount of noise which is allowed to escape from the noise-generating device into the environment, the prior art has utilized many types of mufflers with such attenuating features as sound absorbing linings, reverse flow, cross-flow, side-branch attenuators, and Helmholtz resonators. Such mufflers are generally effective, but bulky, and require a substantial modification of the exhaust channel cross-section.

Mufflers of the prior art are generally housed in housings of elliptical cross-sections inserted in tubular pipes carrying the exhaust gas stream. The external dimensions of such cans are generally an order of magnitude larger than the flow area of the exhaust pipe proper.

The installation requirements of the sound-generating device and/or the structure in which they are housed, often render the use of such voluminous mufflers impossible. Conventionally, in motorcycles, sports-cars and special-purpose vehicles of many types, the only means for carrying the exhaust gas from the source is via a substantially tubular pipe. Attempts of the prior art to provide an effective muffler within the limitations of an elongated tubular envelope have generally failed to provide the required attenuation of sound energy, so that the terms "motorcycle" and "sportscar with straight exhaust pipe" have become synonyms for "noisy machine", for example.

The present invention provides a combination of attenuating elements in a novel structure and arrangement, thus to constitute an effective muffler for exhaust noise within a cylindrical envelope of small diameter and substantial length.

It is therefore a primary object of the present invention to teach the construction and use of a novel muffler for internal combustion engines and other sources of noisy exhaust gas flow, capable of noise-level reductions compatible with good environmental practice.

It is an object of the invention to teach the combination of sound-attenuating elements in a novel, tripartite cylindrical form; such conbinations of elements providing for a double reversal of gas flow through the muffler in a given segment.

It is an object of the invention to teach the manner in which the sound-attenuating segments of tubular muffler, each incorporating a combination of sound-attenuating elements, may be combined in a sequential structure to provide increased noise energy absorption.

It is another object of the invention to provide an effective tubular muffler of economical manufacture, adaptable to all types of stationary and mobile service, and amenable to fabrication of commonly available materials by generally understood and practiced manufacturing methods.

SUMMARY OF THE INVENTION

The foregoing and other objects and advantages which are apparent from the detailed description of the preferred embodiment, are attained in a muffler structure housed within a tubular casing subdivided by radial vanes into three flow passages, each passage being in the form of a circular sector. The passages are not continuous along the length of the muffler, but are interrupted by partitions blocking flow in two of the three passages. Orifices are provided in the radial vanes upstream of the partitions to create a continuous serpentine flow path through the muffler.

The length of the muffler is subdivided into sections which are substantially identical and which occupy respective lengths between 4 to 6 times the diameter of the outer housing. A single segment may be utilized for a given muffler, but preferably a muffler utilizes two or more consecutive sections. Each section incorporates an entry section, a reverse flow section and an exit section. The entry section includes a side-branch resonator and terminates in a Helmholtz chamber. The exhaust gas flow is reversed in direction into the reverse-flow section which contains a side-branch resonator and passes, in another flow reversal, into the exit section, also containing a side-branch resonator. When a further muffler segment is employed, the exit section of the upstream segment and the entry section of the downstream segment become continuous and occupy the same sector of the muffler housing. Under certain circumstances the side-branch resonator associated with one of these elements may be omitted.

The side-branch resonator comprises an enclosed space, defined by the cylindrical outer housing of the muffler, by appropriate end plates and by an inner face bounding the restricted gas flow channel, pierced by a plurality of orifices. Gas pulses laterally through these orifices, impelled by transverse sound waves in the gas stream. Sonic energy is effectively dissipated over a range of characteristic frequencies.

The Helmholtz chamber, one of which is included in each section of the muffler, is defined by a large cavity extending over two of the sections across a large opening in the intervening vane. There is no net flow into or out of the Helmholtz chamber. Attenuation is attained through wave motion across a large orifice facing the gas flow in the entry portion of the muffler section.

The muffler is constructed of sheet metal components formed by conventional techniques, such as stamping, die forming, punching, bending and shearing. The internal structures—including the vanes, partition plates and the side-branch resonator structures may preferrably be preassembled and inserted into the outer housing.

The components may be made from rust resistant materials, such as stainless steel, aluminized steel plate or galvanized plate, or the entire assembly may be plated or coated to provide resistance to corrosion for such applications as in the exhaust mufflers for internal combustion engines. For such applications as the venting of air compressors, where the gas stream is not corrosive, other materials, such as untreated steel, may be utilized.

BRIEF DESCRIPTION OF THE ACCOMPANYING DRAWINGS

The preferred embodiment of the muffler of the invention is described below with reference to the several Figures of the accompanying drawings, wherein.

DESCRIPTION OF THE PREFERRED EMBODIMENT

Figures 1, 2, 3, 4:
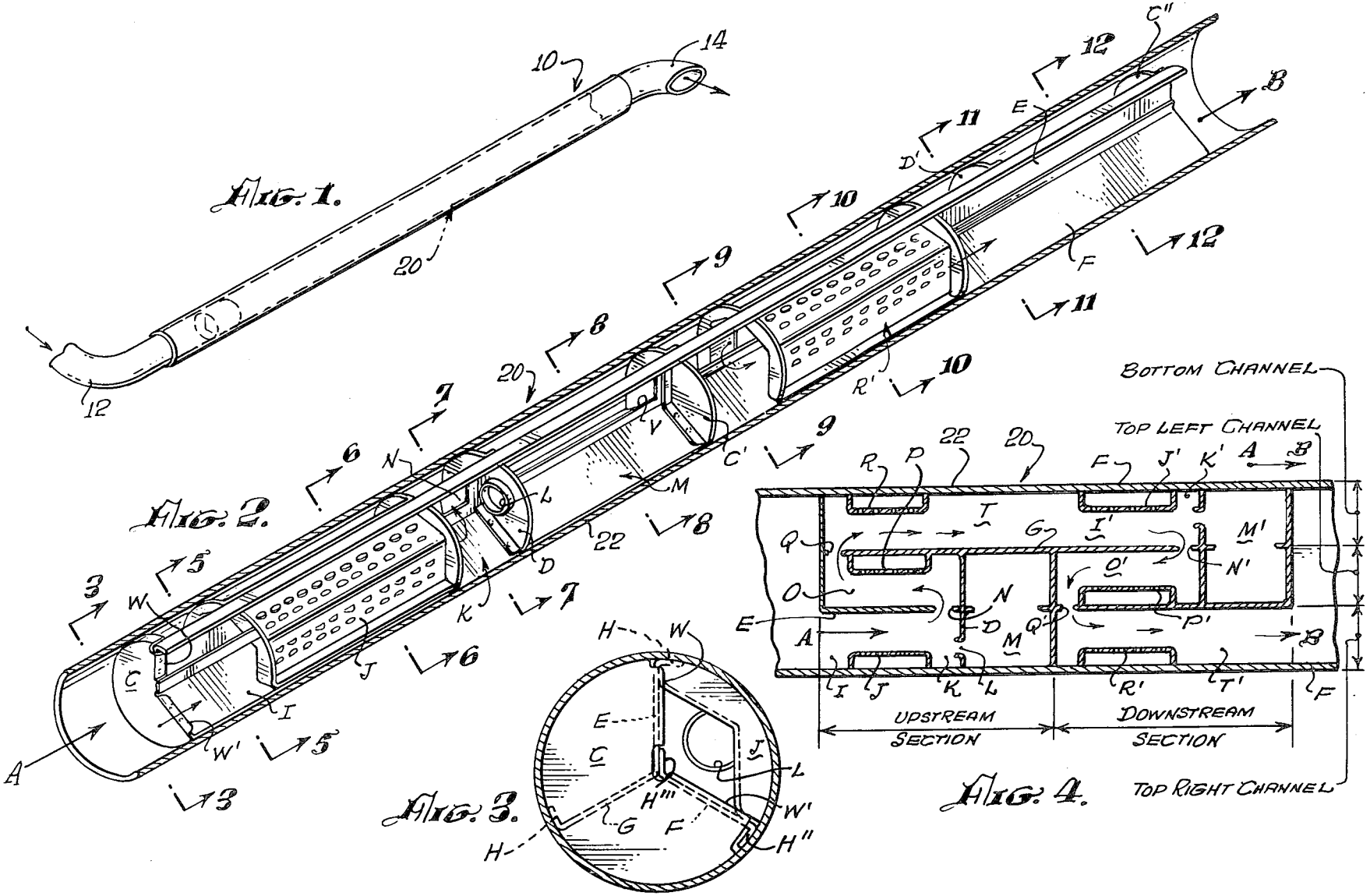
FIG. 1 is a perspective view of a muffler according to the present invention.
FIG. 2 is a cutaway perspective view of the muffler of FIG. 1, showing the arrangement of components.
FIG. 3 is a sectional view taken at Line 3—3 in FIG. 2.
FIG. 4 is a schematic representation of the acoustic elements of two similar muffler sections according to the invention, arrayed in succession in a downstream direction.

FIG. 1 illustrates an automotive exhaust system wherein a muffler 10 according to the invention and incorporating sound-attenuating assembly 20, is interposed between the exhaust header of an internal combustion engine terminating in an exhaust pipe 12, and an exit elbow 14. The elongated cylindrical housing of the muffler 10 replaces, in external form, the exhaust pipe which conventionally conducts the gases exiting the header toward an enlarged muffler housing. The elimination of such enlarged housing is a major advantage of the novel muffler of the invention, and permits installation of the unit 10 in locations and under dimensional restraints not possible with mufflers of the prior art.

The enlarged cutaway perspective view of FIG. 2 shows the acoustical assembly 20 which extends the length of the tubular housing 22, except for the entry socket region for receiving the exhaust pipe 12 and an exit socket region for receiving an exit elbow 14.

The acoustical assembly 20 is constructed about three longitudinally extending vanes, E, F, and G which extend from the axis of the housing 22 and the housing wall, these being angularly spaced 120° apart. The housing is thus divided into three axial channels having cross-sections in the form of 120° sectors. For convenience of reference these channels are herein referred to as a lower channel defined between vanes F and G, a top left channel defined between vanes G and E, and an upper or top right channel defined between vanes E and F. It will of course be understood that the functioning of the muffler is in no way affected by its rotational position or orientation.

FIG. 4 is a schematic representation of two muffler sections, developed by unfolding the structure at vane F into a plane view. One of the sections is termed the upstream section and the other the downstream section, with reference to the exhaust gas flow through the schematic representation in the direction of Arrow A-B. The schematic showing of FIG. 4 corresponds to the structure of FIG. 2, except for the addition of a side-branch attenuator J′ in the entry section I′ of the downstream section. This component may be incorporated or omitted, as it is omitted from assembly 20 of FIG. 2, at the option of the designer.

Figure 5:
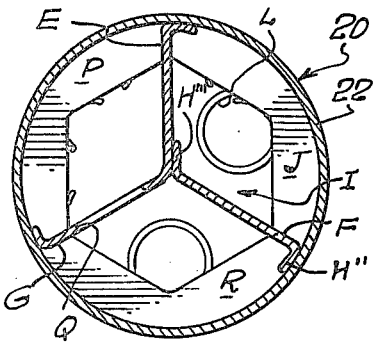
FIG. 5 is a sectional view taken at Line 5—5 in FIG. 2.
Figure 6:
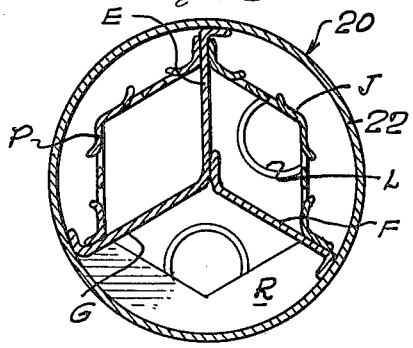
FIG. 6 is a sectional view taken at Line 6—6 in FIG. 2.
Figure 7:
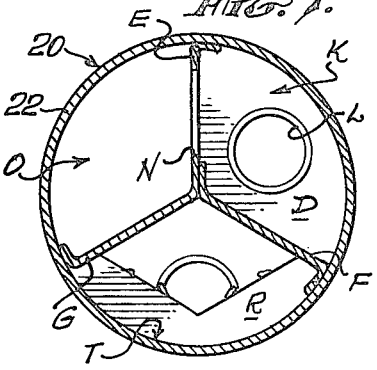
FIG. 7 is a sectional view taken at Line 7—7 in FIG. 2.
Figure 8:
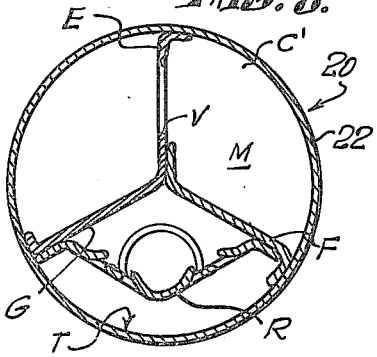
FIG. 8 is a sectional view taken at Line 8—8 in FIG. 2.
Figure 9:
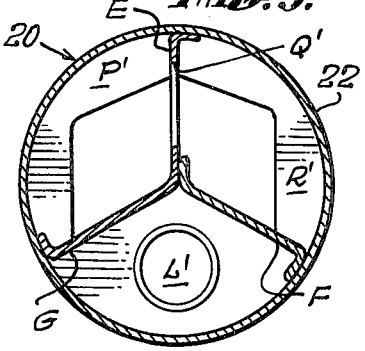
FIG. 9 is a sectional view taken at Line 9—9 in FIG. 2.
Figure 10:
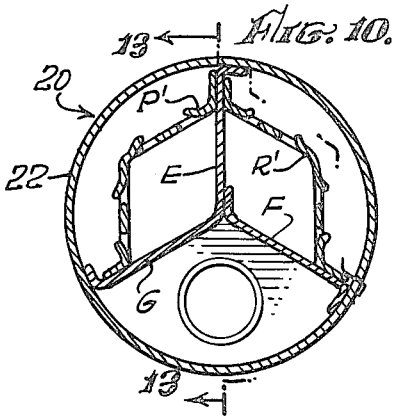
FIG. 10 is a sectional view taken at Line 10—10 in FIG. 2.
Figure 11:
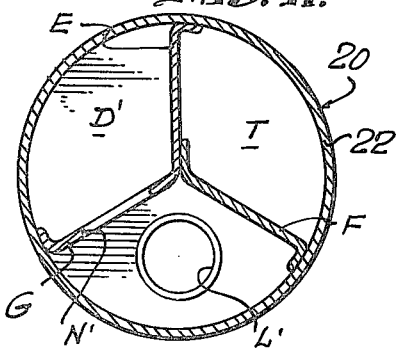
FIG. 11 is a sectional view taken at Line 11—11 in FIG. 2.
Figure 12:
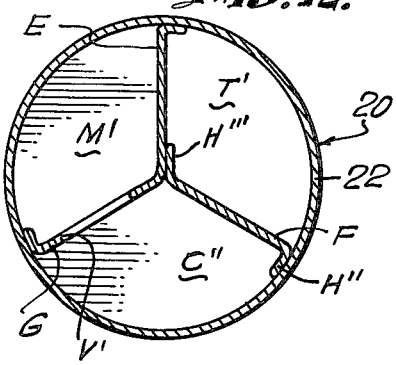
FIG. 12 is sectional view taken at Line 12—12 in FIG. 2.

FIGS. 5 through 12 are sectional views taken at successive positions along the muffler 10 in FIG. 2. FIG. 5 shows the flow channels and the upstream phases of side-branch attenuator assemblies J, P and R. FIG. 6 is a sectional view of side-branch attenuators J and P, and shows orifice plate openings interconnecting these attenuators with adjacent flow channels. FIGS. 7 and 8 illustrate features of the Helmholtz resonator chamber M and its communication with the exhaust gas stream, the Helmholtz chamber extending across partitioned-off sections of both the top right and top left flow channels, interconnected by port V. FIG. 9 shows the upstream end plate of attenuator R′ and the downstream end plate of attenuator P′, and for Q′ interconnecting the reverse-flow and exit portions of the second section. FIG. 10 is taken through the interiors of side-branch attenuators P′, R′ of the second section, and FIG. 11 shows transfer port N′ through which the gas stream enters the reverse flow portion of the second section. FIG. 12 shows the arrangement of partition plate C′ extending athwart the top left and bottom flow channels, leaving the top right channel free to define the exit portion T′.

Figure 13:
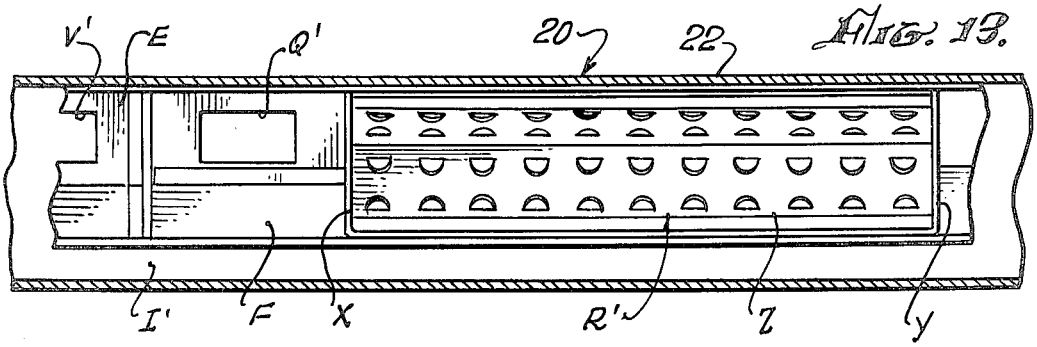
FIG. 13 is a fragmentary longitudinal sectional view taken at Line 13—13 in FIG. 10.

The longitudinal fragmentary sectional view of FIG. 13 illustrates the structure of the typical side-branch attenuator R′ and orifice plate Z, upstream end plate X, and downstream end plate Y.

Exhaust gas enters the muffler in the direction of Arrow A (FIG. 2) and is diverted into the upper right flow channel by partition plate C which blocks the upstream ends of the bottom and top left flow channels and entrance region I of the top right flow channel is adjoined on its downstream end by a side-branch resonator J. Side-branch resonator J, as well as the other side-branch resonators of the muffler assembly 20, is formed of a sheet-metal plate with multiple perforations, bent centrally with an included angle approximating 120°, attached to the adjacent vanes (E, F for the attenuator J), and blocked off with end plates shaped to fit the gap between the orifice plate and the outer housing 22. In this manner the gas flow is constrained to flow in a lozenge-shaped channel defined by the boundary vanes and the perforated orifice plate. There is essentially no net gas flow through the side-branch resonator, such flow being interdicted by the end plates, but pulsating flow is created across each orifice, at a frequency defined by the resonance of the internal cavity between the orifice plate and the outer housing. Acoustic energy is dissipated by the interaction of the flowing gas stream in the channel adjacent to the orifice plate and the quiescent gas mass within the side-branch attenuator. The length of the side-branch attenuator may be varied to accommodate particular service conditions, but in a preferred form it is approximately twice the diameter of the cylindrical housing 22.

After passing attenuator J, the exhaust gas passes into a chamber K and, upon encountering a partition plate D which blocks both the top right and top left flow channels, is turned to flow through a port N in the vane E. The chamber K is also the terminus of a nozzle L which opens into a Helmholtz chamber M whose axial dimension extends between the partition plate D and a similar partition plate C′, also across the upper left and upper right flow channels. The vane E is pierced by an elongated port V intermediate the plates D and C', so as to convert that portion of the muffler volume defined between these plates and the vanes F and G into a single chamber whose sole communication with the exhaust gas flow channel is through the orifice L, opening into Chamber K. Because of the relatively large volume of the resonator chamber M, whose axial length is similar to that of the attenuator J at 2 diameters, and the provision of only a single orifice, the resonant interaction of the exhaust gas stream with the static gas volume therein occurs at a much lower frequency than in the case of the attenuator J and, consequently, acoustic energy is abstracted from the exhaust gas at a different frequency band, previously unaffected.

The exhaust gas is reversed, after passing the port N, and flows through a region O toward the upstream face of partition C, past a side-branch attenuator P, in the upper left flow channel between vanes E and G. At the partition plate C the flow is reversed once again, through a port Q and enters an exit region T, flowing past a third side-branch attenuator R. The exit region is located in the bottom flow channel of the assembly, between vanes G and F.

The foregoing description relates to the first section of the sound-attenuating assembly 20, incorporating an entrance region, a reverse-flow region and an exit region, in the upper right, upper left, and bottom flow channels of the assembly, respectively. The entire section extends axially between partition plates C and C', and incorporates three side-branch attenuators and a Helmholtz chamber. Two flow reversals of the exhaust gas stream are required through ports piercing the longitudinal divider vanes. Sound energy is dissipated in the flow reversals and in the expansions past the downstream edge of each side-branch attenuator, as well as in the interaction between the acoustically active interiors of the attenuators and the Helmholtz resonator chamber.

While each section of the muffler assembly 20 is a complete muffler in itself, in most applications it is desirable to remove more acoustic energy from the exhaust gas flow than is readily accomplished in a single section. Thus, in the muffler 10 two essentially identical sections are included in the acoustic assembly 22.

The gas flow enters the second section through an entrance region I' which is an axial continuation of the exit region T of the first segment. In the assembly 22, no side-branch attenuator is provided in the entrance region I', the attenuator R of the first segment being moved slightly downstream to alter somewhat the resonance conditions existing in the elongated channel formed by the adjoining flow regions associated with the two sections.

The gas flow leaves the bottom flow channel through a port N' opening from an expansion chamber K', and reverses flow direction through a region O' in the upper left flow channel. The chamber K' communicates with a Helmholtz cavity M' through an orifice L' in partition plate D'. These components, as well as transfer port Q', exit channel T' and side-branch attenuators P' and R' are in all respects similar to the corresponding elements of the first section, except for their location in different flow channels and engagement with different partition vanes. The final exit flow channel T' opens into the downstream socket region and occupies the upper right sector of the muffler cross-section, in line with the entrance region I'. A partition plate C'' closes off the sectors at the upper left and bottom of the muffler tube and serves as the boundary of the Helmholtz chamber M'. The direction of the exit flow is indicated by Arrow B.

FIG. 3 is a sectional view of the upstream socket region of the muffler 10, bounded by the cylindrical housing 22, and shows the partition plate C, an end plate of the side-branch attenuator J, and the lozenge-shaped flow channel in entrance section I, adjacent to the attenuator canister. The upstream edges of the flow channel-defining vanes E, F and G are shown in broken lines. The Vanes E and G are formed of a single sheet-metal element, centrally bent to an included angle of 120° to enclose the upper left flow channel, and has flanges H, H' at the ends of vanes G, E, respectively, for engagement with the interior periphery of the housing 22.

The third vane F is formed from a flat plate of sheet metal with flanges H'' and H''' along the longitudinal edges. The inner flange H''' is bent at 120° relative to the main panel of the vane and is spotwelded to the vane E. The outer flange H'' is bent at an angle slightly larger than 90° and is secured to the inner surface of the tubular muffler housing 22.

Referring to FIGS. 2 and 3, the partition plate C has a circumferential flange U extending the 240° arc of the partition plate periphery, and with linear flanges W, W' spotwelded to the vanes E and F, respectively. The interior partition plates, D, C' and D', are not provided with the circumferential flanges and are assembled by flanges similar to flanges W, W'. These subsidiary partition plates are split, being formed of two 120° segments each, so as not to interrupt the continuous vanes E, F and G which extend the length of the assembly 20 and provide the structure about which the other components are assembled.

The preferred embodiment of the invention herein illustrated and described represents only one form in which the invention may be practiced. The provision of additional vanes, to subdivide the interior of the muffler tube into an odd number of flow channels, is possible. For example, five or seven parallel flow paths may be provided so as to form a serpentine path through the muffler, with a side-branch attenuator in each longitudinal segment, and with one or more Helmholtz resonators facing the flow direction.

Such changes in the form, arrangement of internal components, or the multiplication of such components, are possible, and may suggest themselves to one skilled in the art of constructing sound-absorbing flow channels upon exposure to the teachings herein. Such changes, as well as changes in the constructional details and manufacturing processes, shall be deemed to be encompassed by the disclosure, the invention being delimited solely by the appended claims.

The inventor claims:

1. A sound-attenuating muffler for reducing the acoustic energy in an exhaust gas stream, comprising:

an elongated muffler housing having a tubular outer wall and an axis, at least three vanes axially extending between a first position adjacent to one end of the housing and a second position adjacent to the other end of the housing, said vanes extending radially between the axis and said wall to define an odd number of axially extending flow passages, at least one axially extending sound-attenuating section defined by three partition plates axially spaced in the downstream direction, said partition plates including an entry partition blocking all said passages but one entry flow passage, a reverse flow partition blocking all said passages but an exit flow channel, and an exit partition blocking all said passages but said exit flow channel, said vanes defining transfer port means including one flow port in at least two of the vanes, the respective positions of the flow ports in the respective vanes alternating from a position adjacent to the flow-reversing partition to a position adjacent to the entry partition to provide a serpentine exhaust gas flow path traversing the sound-attenuating section in alternating directions along each flow passage in sequence from the entry flow channel to the exit flow passage, and a resonator chamber in each said section, positioned between the flow-reversing partition and the exit partition and extending across said flow passages except the exit channel, said resonator chamber being interconnected by open ports defined in each of said vanes not bounding the exit channel, and the resonator chamber communicating with said serpentine flow path via at least one opening into the entry channel.

2. A sound-attenuating muffler according to claim 1, and further including a side-branch attenuating chamber in each such axially extending section and defined by an orifice plate defining a plurality of openings extending axially between and spaced from the entry partition and said flow-reversing partition, said side-branch chamber being radially intermediate the housing axis and the wall of the housing.

3. A sound-attenuating muffler according to claim 2, and further including seal means between the edges of the orifice plate and the housing wall.

4. A sound-attenuating muffler according to claim 1, wherein the axial spacing between the entry partition and the exit partition ranges from four to six times the internal diameter of said housing.

5. A sound-attenuating muffler according to claim 1, wherein the number of said longitudinal vanes is three, and said muffler incorporates a single sound-attenuating assembly segment, the entry partition being located adjacent to one end of the housing and the exit partition located adjacent to the other and downstream end of the housing.

6. A sound-attenuating muffler according to claim 1, wherein the number of said longitudinal vanes is three, and said muffler incorporates two sound-attenuating sections, the entry flow channel of a downstream section immediately adjoining the exit flow channel of an upstream section.

7. A sound-attenuating muffler according to claim 6, wherein the axial spacing between said entry partition and said exit partition for each said sections is between four and six times the internal diameter of the housing.

8. A sound-attenuating muffler according to claim 7, wherein the exit partition of the upstream section constitutes the partition of the downstream section.

9. A sound-attenuating muffler according to claim 1, wherein the length of each section is between $4\frac{1}{2}$ times and $5\frac{1}{2}$ times the internal diameter of the housing.

10. A sound-attenuating muffler according to claim 2, wherein the axial extent of the orifice plate is at least twice the internal diameter of said housing, and the flow-reversing partition and the exit partition are spaced apart at least twice the internal diameter of the housing.

* * * * *